US007886495B2

(12) United States Patent
Nebgen

(10) Patent No.: US 7,886,495 B2
(45) Date of Patent: Feb. 15, 2011

(54) FASTENING MEANS OF CERAMICS FOR FASTENING A REFRACTORY LINING

(76) Inventor: Peter Nebgen, Josef-Zillikon-Strasse 10, 56653 Wassenach (DE)

( * ) Notice: Subject to any disclaimer, the term of this patent is extended or adjusted under 35 U.S.C. 154(b) by 514 days.

(21) Appl. No.: 11/933,565

(22) Filed: Nov. 1, 2007

(65) Prior Publication Data

US 2008/0104920 A1 May 8, 2008

(30) Foreign Application Priority Data

Nov. 2, 2006 (DE) ..... 20 2006 016 919 U

(51) Int. Cl.
*F27D 1/00* (2006.01)
*E04B 2/04* (2006.01)

(52) U.S. Cl. ..... 52/506.02; 52/506.05; 411/450

(58) Field of Classification Search ..... 52/506.02, 52/506.05, 511, 407.4; 411/512, 526, 349, 411/549, 533, 82; 110/336
See application file for complete search history.

(56) References Cited

U.S. PATENT DOCUMENTS

| | | | | |
|---|---|---|---|---|
| 2,021,610 | A * | 11/1935 | Quint | 52/379 |
| 3,362,698 | A * | 1/1968 | Cerny et al. | 432/119 |
| 3,687,093 | A * | 8/1972 | Byrd, Jr. | 110/343 |
| 3,747,291 | A * | 7/1973 | Perigo et al. | 52/127.7 |
| 3,909,907 | A * | 10/1975 | Davis | 29/407.1 |
| 4,030,261 | A * | 6/1977 | Coleman | 52/511 |
| 4,086,740 | A * | 5/1978 | Annett | 52/511 |
| 4,157,001 | A | 6/1979 | Pickles et al. | |
| 4,576,532 | A | 3/1986 | Hanson et al. | |
| 4,796,543 | A * | 1/1989 | Barkley | 110/173 R |

(Continued)

FOREIGN PATENT DOCUMENTS

DE EP0007465 A * 2/1980

(Continued)

*Primary Examiner*—Brian E Glessner
*Assistant Examiner*—Beth Stephan
(74) *Attorney, Agent, or Firm*—Bill C. Panagos; Rader, Fishman & Grauer PLLC

(57) ABSTRACT

The present invention relates to a fastening means (1) of ceramics for fastening a refractory lining, wherein the fastening means (1) comprises a hollow shaft (2) which can be inserted into a recess left open in the lining and has a positive locking element (10) provided at its free end (9) as well as a collar (3) projecting beyond the shaft (2) at its other end which can be applied at the outside of the lining. For improving this known fastening means with respect to a secure protection of the metallic fastening part from the atmosphere in the combustion chamber, the present invention suggests to provide an undercut opening towards the hollow shaft in the region of the other end. The refractory lining furthermore provided by the present invention comprises at least one refractory plate with at least one recess in which a metallic retaining element projecting from a furnace housing is received, a ceramic fastening means (1) connected to the retaining element which comprises a hollow shaft (2) projecting into the recess, the free end (9) of which is connected to the metallic retaining element, and a collar (3) provided at the other end which adjoins the lining as well as a ceramic plug received in the hollow shaft, and it is characterized in that the plug comprises a swelling received in an undercut (15) left open at the fastening means (1).

16 Claims, 1 Drawing Sheet

U.S. PATENT DOCUMENTS 4,884,932 A * 12/1989 Meyer ..... 411/373
5,059,369 A * 10/1991 Schiferl ..... 264/87
5,171,118 A * 12/1992 Rothenbuhler ..... 411/480

FOREIGN PATENT DOCUMENTS

DE 3604493 C1 * 12/1986
FR 2327505 5/1977
FR 2422919 11/1979

* cited by examiner

FASTENING MEANS OF CERAMICS FOR FASTENING A REFRACTORY LINING

TECHNICAL FIELD

The present invention belongs to the field of fastening refractory linings, for example of a furnace. These refractory linings always consist of plates or mats which can also be multi-layered and are usually formed of ceramic fiber or mineral fiber. For fastening the ceramic lining at the furnace housing, the lining comprises recesses into which metallic retaining elements, for example pins or bolts, fixed to the housing project.

These pins or bolts can extend beyond the lining. In this case, the lining is secured by connecting disks that can be positively connected to the free end of the pin or bolt, respectively, and which adjoin the outer side of the lining facing the combustion chamber. The free end of the bolt or the fastening disk is directly exposed to the furnace temperature in this type of fastening.

The above-described fastening of the lining is therefore not suited for fastening the refractory lining at elevated temperatures. In this case, the free end of the bolt is disposed within the lining and thus offset towards the inside with respect to the outer side of the lining. The lining is fastened via a generic fastening means of ceramics which has a shaft projecting into a recess left open in the lining. At the front end of the shaft, a positive locking element is provided which can be positively connected to the bolt, the connection always being of the bayonet catch type. For this, the bolt comprises projections distributed at its circumference which can be inserted into correspondingly formed slots in the positive locking element. The free end of the bolt is then located in the hollow shaft. The metallic retaining bolt can be designed as bayonet pin with a round or rectangular cross-section or as setscrew with a fastening nut. By rotation, for example by 90°, the positive locking element grips behind the projections. Then, the fastening element is positively connected to the metal part. At the other end of the shaft, which is located in the plane of the front side of the lining, the generic fastening means comprises a collar which can be applied to the lining at the outer side thereof. The collar can directly adjoin the outer side of the lining. Possibly, the collar adjoins the lining with an interposed intermediate ceramic disk.

After the fastening means has been positively connected to the metal part of the furnace housing, the hollow shaft open towards the combustion chamber is closed by a plug which is always formed of a plastic mixture consisting of ceramic fibers and binders which is filled into the conical cavity of the shaft and cures therein. The plug protects the metal part projecting into the hollow shaft in the front area from the heat of the combustion chamber.

However, it showed that the plug diminishes under operational conditions and finally falls out of the hollow shaft open towards the combustion chamber, and that thus the metallic retaining part is exposed to corrosion due to the hot gases.

To react to this problem, a lid has been suggested in the past which is formed of the same ceramic material as the fastening means and which can be screwed to the fastening means via a thread formed in the region of the collar at the inner side of the hollow shaft. This suggestion, however, could not establish itself on the market due to its high production costs.

It is an object of the present invention to provide a fastening means of the type mentioned in the beginning which ensures secure protection of the metallic fastening part from the atmosphere in the combustion chamber of a furnace. Furthermore, with the present invention, a refractory lining satisfying these demands is to be provided.

SUMMARY

For achieving the above-mentioned object, the present invention provides a fastening means. It differs from the generic prior art in that in the region of the other end of the shaft, an undercut opening towards the hollow cone is provided. The undercut is dimensioned such that the plastic mixture forming the plug made of ceramic fiber and binder forms a swelling which fills the undercut when it is filled into the hollow shaft, the swelling being sufficient for securely retaining the plug in the hollow shaft even in case of a diminution of the plug during the operation of the furnace. Any recess extending from the hollow shaft radially outside which has a tapered design towards the other end of the shaft is considered as undercut. The thread of a screw is not considered as undercut in the sense of the present invention. In contrast to threads, the undercut in particular does not comprise any opening permitting the removal of the plug from the hollow shaft by rotation of the plug relatively to the shaft. Preferably, the undercut is designed without pitch. The undercut rather extends in the circumferential direction. Here, it is not necessary for the undercut to uniformly extend over the whole circumference of the shaft. The undercut can also be provided so as to be distributed across the circumference in portions, for example with at least two, preferably several, undercut segments extending in the radial direction in the cross-sectional direction.

As a matter of principle, the undercut can extend from the inside circumference of the shaft in the region of the other end at any point with respect to the shaft axis. However, the undercut is preferably provided at the level of the collar. The undercut is thus located within a region formed by the front and back side of the collar. The undercut is there preferably provided approximately with the thickness of the collar, i.e. it has an extension in the direction of the shaft axis corresponding to the extension of the collar in this direction.

It proved to be practical to form the undercut rotationally symmetrically with respect to the shaft axis. As has already been explained above, other shapes, for example undercut segments arranged radially, are also conceivable, which are filled with the plastic mixture of ceramic fibers and binders when these are filled in.

In view of a reliable manufacturability of the fastening means, the same should be essentially designed as component having the same wall thickness also at the transition between the collar and the shaft. For this, according to a preferred further development of the present invention, it is suggested to provide a step located between the undercut and a conical inner wall of the shaft. This step is preferably located with respect to the shaft axis outside a region provided between the front and back sides of the collar. In particular, the step approximately begins where the back side of the collar is situated. The major part of the step projects beyond the back side with respect to the shaft axis.

The undercut preferably comprises a truncated recess the smallest diameter of which is situated in the plane formed by the outer side of the collar. The truncated recess can extend with respect to the shaft axis across the complete thickness of the collar. With respect to the formation of wall thicknesses as uniform as possible, it is, however, preferred to leave open a cylindrical recess as part of the undercut following the truncated recess, i.e. following the largest diameter of the truncated cone, which cylindrical recess preferably passes over a large radius into a wall section essentially extending transversely to the shaft axis, the wall section leading directly or with the interposed step to the inside circumference of the shaft.

It further proved to be practical to form the smallest diameter of the truncated recess so as to approximately correspond to the diameter that results by the section of the plane formed by the outer side of the collar with an enveloping surface extended in the direction of the shaft axis to the inner surface of the shaft. This enveloping surface contains the inner surface of the shaft and thus has a design corresponding to the design of the inner surface of the cone. The smallest diameter of the truncated recess is in the plane which also comprises the outer side of the collar. The undercut correspondingly reaches down to the outer side of the collar.

Insofar as in the present description the design in particular of the shaft and associated surfaces are described using a diameter, this is done with the idea that the shaft has a rotationally symmetric design as is known in the prior art. However, other designs than rotationally symmetric ones are also possible, for example triangular, rectangular or polygonal cross-sectional shapes of the shaft at its outer side and/or its inner side. In this case, the "diameter" means the dimension corresponding to a diameter in case of a circular design.

With respect to achieving the further object underlying the invention, the present invention provides a refractory lining. This is a refractory lining with at least one refractory plate or mat with at least one recess. This recess receives a metallic retaining element projecting from a furnace housing. The refractory lining further comprises a ceramic fastening element connected to the metallic retaining element which has been already described in detail above with its special embodiment. The fastening element comprises a hollow shaft projecting into the recess, the free end of which is connected to the metallic retaining element and at the other end of which a collar is provided which adjoins the lining directly or indirectly with an interposed disk and projects beyond the same. A ceramic plug is received in the hollow shaft of the fastening element. This is preferably a plug which is formed by filling in a curing mixture of a ceramics with binder. The ceramics can be present in fiber and/or powder form. According to the invention, the plug comprises a swelling which is arranged in an undercut left open at the fastening means. By this design, the plug is positively held in the fastening means that is hollow inside, such that, even if the plug diminishes during the use of the furnace, there is no risk of the plug falling out of the fastening means.

Preferred further developments of the refractory lining can be taken from the depending claims concerning the fastening means.

BRIEF DESCRIPTION OF DRAWINGS

The present invention will be illustrated more in detail below with reference to an embodiment in connection with the drawing.

DETAILED DESCRIPTION OF THE PREFERRED EMBODIMENT

Figure 1:
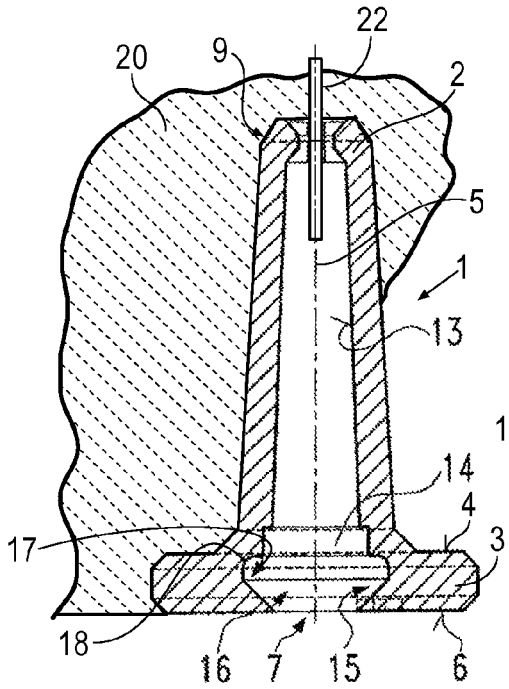
FIG. 1 shows a longitudinal sectional view of the embodiment.
Figure 2:
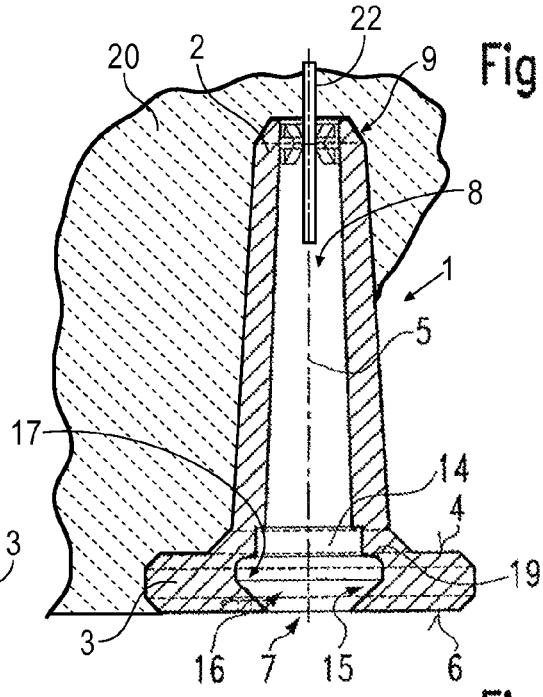
FIG. 2 shows another longitudinal sectional view of the embodiment which is rotated by 90° with respect to that of FIG. 1.
Figure 3:
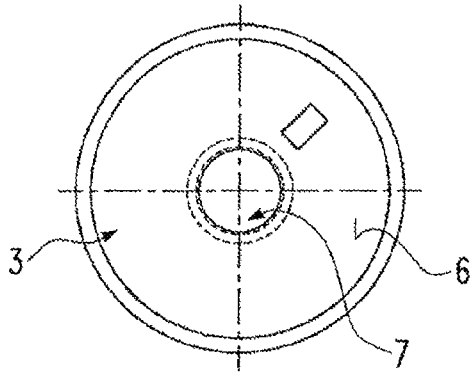
FIG. 3 shows a plan view of the outer side of the embodiment shown in FIGS. 1 and 2.
Figure 4:
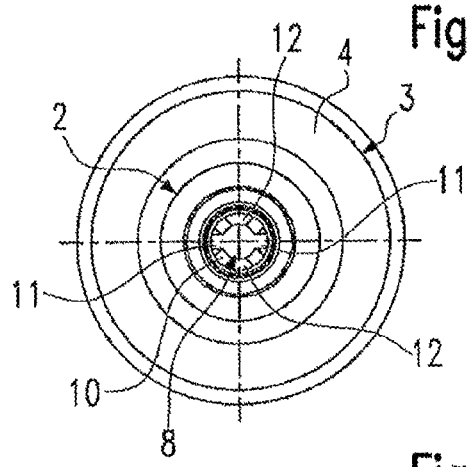
FIG. 4 shows a plan view from the other side.

The fastening means 1, as shown in FIGS. 1 and 2, is positioned within a refractory lining 20 and on a protruding metallic retaining element 22 that extends from a furnace wall (as described above). The fastening means 1 is formed of ceramics and comprises a slightly conical hollow shaft 2 and a collar 3 formed at the shaft. The collar 3 forms a back side 4 which can adjoin a lining 4 and extends at a right angle to an axis 5 of the shaft 2. At the front or outer side 6 of the collar 3 opposite the back side 4, there is an opening 7 leading to a passage 8 through the fastening means 1 penetrating the hollow shaft 2.

The shaft 2 has a free end 9 towards which the shaft 2 is tapered. At this free end 9, a positive locking element 10 is provided which projects beyond the inside circumference of the conical shaft 2 to the inside. The positive locking element 10 is integrally formed with the shaft 2 and is also made of ceramics, in the present case as a disk-shaped bayonet catch element designed with slots 11 and projections 12 alternately provided at the circumference.

The outer walls of the slots 11 are each formed by the extension of the cone-shaped inside circumference 13 of the shaft 2.

At its end facing away from the positive locking element 10, the inside circumference 13 passes into a step 14 which is designed cylindrically with a larger diameter than the internal diameter of the shaft 2 provided at the other end. The limitation of the step 14 on the side of the shaft is formed by an annular face extending essentially at a right angle to the axis 5. Correspondingly, the inside circumference 13 of the shaft 2 passes into the step 14 with a sharp edge.

Following the step, an undercut 15 is provided which comprises a truncated recess 16 forming the opening 7. Following the truncated recess 16 and having the same diameter as the largest diameter of the truncated recess 16, a cylindrical recess 17 is formed as part of the undercut 15. This cylindrical recess 17 passes into a wall section 19 in a bent manner over a radius 18, the wall section 19 connecting the cylindrical recess 17 with the step 14.

The truncated recess 16 and the step 14 are, as is the inner hollow shaft 2, designed rotationally symmetrically and arranged coaxially to the axis 5 of the shaft 2. The smallest radius of the truncated recess 16 located in the plane of the outer side 6 approximately corresponds to the diameter that results when the conical inside circumference 14 is extended in the axial direction to the outer side 6 in the plane of the outer side 6. The smallest diameter of the truncated recess is in any case not smaller than the largest diameter at the inside circumference 13 of the conical shaft 2. This in general applies to undercuts of any type, independent of the concrete design of the undercut.

In the shown embodiment, the undercut 15 is designed such that the ratio of the smallest diameter of the undercut to the largest diameter of the undercut (corresponding to the diameter of the cylindrical recess) is approximately 0.5. The ratio should not be larger than 0.8, preferably not larger than 0.65, taking into consideration a possible diminution of the plug when the embodiment is used.

The invention claimed is:

1. A refractory lining ceramic fastener, comprising:

a hollow shaft, having a first free end and an opposite second end, wherein the first free end includes a positive locking element and the second end includes a collar projecting beyond the hollow shaft and a rigid undercut opening extending in the hollow shaft, wherein a step is provided, following the collar with respect to the shaft at a level of the collar axis, between the undercut and a conical inside circumference of the shaft, and wherein the hollow shaft is inserted into a recess in a refractory lining.

2. The refractory lining ceramic fastener according to claim 1, wherein the undercut is provided at the level of the collar.

3. The refractory lining ceramic fastener according to claim 1, wherein the undercut is approximately the width of the collar.

4. The refractory lining ceramic fastener according to claim 1, wherein the undercut is formed rotationally symmetrically with respect to the shaft axis.

5. The refractory lining ceramic fastener according to claim 1, wherein walls are provided in the direction of the shaft axis behind the collar and are provided essentially with the same wall thickness at a transitional area to the shaft.

6. The refractory lining ceramic fastener according to claim 5, wherein the wall thickness in the transitional area corresponds to the wall thickness of the shaft.

7. The refractory lining ceramic fastener according to claim 1, wherein the undercut includes a truncated recess having a smallest diameter located in the plane formed by an outer side.

8. The refractory lining ceramic fastener according to claim 7, the smallest diameter approximately corresponds to the diameter formed by the intersection of the plane formed by the outer side of the collar with an enveloping surface extended in the direction of the shaft axis at the inside circumference.

9. A refractory lining system, comprising:

at least one refractory plate with at least one recess;

a metallic retaining element projecting from a furnace housing through the recess; and a ceramic fastener connected to the retaining element, wherein the ceramic fastener includes a hollow shaft having a free end and an opposite collar end, the free end is projecting into the recess and is connected to the metallic retaining element, and the collar adjoins the lining and a ceramic plug received in the hollow shaft, and wherein the ceramic plug includes a swelling, which is received in a rigid undercut in the hollow shaft at a level of the collar; wherein a step is provided, following the collar with respect to the shaft axis, between the undercut and a conical inside circumference of the shaft.

10. The refractory lining system according to claim 9, wherein the undercut is at the level of the collar.

11. The refractory lining system according to claim 9, wherein the undercut is approximately the width of the collar.

12. The refractory lining system according to claim 9, wherein the undercut is formed rotationally symmetrically with respect to the shaft axis.

13. The refractory lining system according to claim 9, wherein walls are provided in the direction of the shaft axis behind the collar and are provided essentially with the same wall thickness at a transitional area to the shaft.

14. The refractory lining system according to claim 13, wherein the wall thickness in the transitional area corresponds to the wall thickness of the shaft.

15. The refractory lining system according to claim 9, wherein the undercut includes a truncated recess having a smallest diameter located in the plane formed by an outer side.

16. The refractory lining system according to claim 15, wherein the smallest diameter corresponds to an approximate diameter formed by an intersection of the plane formed by the outer side of the collar with an enveloping surface extended in the direction of an shaft axis at the inside circumference.

* * * * *